US005370026A

United States Patent [19]

Cavagna

[11] Patent Number: 5,370,026

[45] Date of Patent: Dec. 6, 1994

[54] CUTTING UNIT FOR CUTTING OFF MATERIAL IN STRIP FORM

[75] Inventor: Elio Cavagna, Melegnano, Italy

[73] Assignee: Elio Cavagna S.r.l., Melegnano, Italy

[21] Appl. No.: 34,710

[22] Filed: Mar. 22, 1993

[30] Foreign Application Priority Data

Mar. 23, 1992 [IT] Italy ..... MI92 A 000677
Feb. 10, 1993 [IT] Italy ..... MI93 U 000106

[51] Int. Cl.[5] ..... B26D 1/24; B26D 7/22; B26D 7/26

[52] U.S. Cl. ..... 83/478; 83/497; 83/500; 83/508.2; 83/699.51

[58] Field of Search ..... 83/478, 497, 498, 501, 83/504, 506, 505, 507, 508.2, 508.3, 676, 675, 500, 699.51

[56] References Cited

U.S. PATENT DOCUMENTS 2,571,201 10/1951 Clem .
3,143,024 8/1964 Markowski .
4,257,298 3/1981 Aykut ..... 83/506
4,438,673 3/1984 Noffke et al. ..... 83/497
5,131,304 7/1992 Paavola ..... 83/478

FOREIGN PATENT DOCUMENTS 0113668 7/1984 European Pat. Off. .
0238686 9/1987 European Pat. Off. .
333001 9/1989 European Pat. Off. ..... 83/478
2821957 11/1979 Germany .
3146123 6/1983 Germany ..... 83/478
3333492 4/1985 Germany .
3633655 4/1988 Germany .
3841576 1/1990 Germany .

*Primary Examiner*—Hien H. Phan
*Attorney, Agent, or Firm*—Bucknam and Archer

[57] ABSTRACT

Cutter for material in strip form preferably of paper having a hollow supporting body (20), a blade holder head (12), a shaft (18) equipped with a piston (24) running in the cavity (21) of the supporting body and connected to the blade holder head (12) by an elastically deformable arm (16), a system for controlled rotation of the blade holder head, a system for mounting the blade holder head (12) on the shaft (18) and a case (60) for covering and protection of the blade (14) in the operational phase or the rest phase and fixed to the stem of a piston (62) sliding in a chamber (64) in the bottom of the blade holder head (12).

8 Claims, 2 Drawing Sheets

CUTTING UNIT FOR CUTTING OFF MATERIAL IN STRIP FORM

BACKGROUND OF THE INVENTION

1. Field of the Invention

The present invention relates to a cutting unit for cutting off material in strip form, preferably paper.

2. Description of the Prior Art

In the known art and in particular in the paper and cardboard article making field there are known cutting units which generally include a usually round blade holder head connected to a support which can be translated and positioned along a beam or the like.

Said known cutting units are equipped with a system of ducts supplied by a pressurised fluid, generally air, which determines both the desired positioning of the cutting unit along the beam and the lowering of the blade during operation in relation to a counterblade.

The known cutting units, although fulfilling in a fairly satisfactory manner their functions, display considerable shortcomings and limitations. Thus for example in some cutting units replacement of the blade holder head in case of wear or other requires complicated and laborious operations by the operator. In other cutting units replacement of the blade holder head is fast but the structural means of engagement used are complicated and in time unreliable because subject to divers stresses during operation of the cutting units.

Another considerable shortcoming is that the cut-off blade is not adequately protected, in particular in the nonoperating position, so that it can cause undesired harm to the operator.

Another shortcoming of the known cutting units is that the blade holder head cannot be rotated around its axis so that in case of wear of the counterblade edge it is necessary to reposition the beam of the cutting unit to use the opposite edge of said counterblade. Said operation negatively affects the operating cycle of said cutting units.

In addition, the impossibility of rotating the blade holder head does not allow, e.g. for material cut-off requirements, performing the so-called "scissors" cut-off of changing the angular positioning of the blade in relation to the counterblade depending on the type of material to be cut off.

SUMMARY OF THE INVENTION

The object of the present invention is to provide an improved cutting unit for cutting off preferably paper material in strip form which would not display the above shortcomings of known cutting units.

In accordance with the present invention said object is achieved by a cutting unit which, in its more general aspects, comprises means of rapid replacement of the blade holder head, means of controlled rotation of the blade holder head by an angle whose amplitude is between 0° and 180° and a protective element for the round blade whether in operating or nonoperating phase. In addition, the cutting unit of the present invention comprises a device for micrometric rotation of the blade holder head and hence of the cut-off angle formed between the blade and the counterblade.

BRIEF DESCRIPTION OF THE DRAWINGS

The characteristics and advantages of the improved cutting unit of the present invention can be better understood from the following description in which reference is made to the annexed drawings showing by way of nonlimiting example an embodiment of the present invention wherein.

DESCRIPTION OF THE PREFERRED EMBODIMENTS

Figure 1:
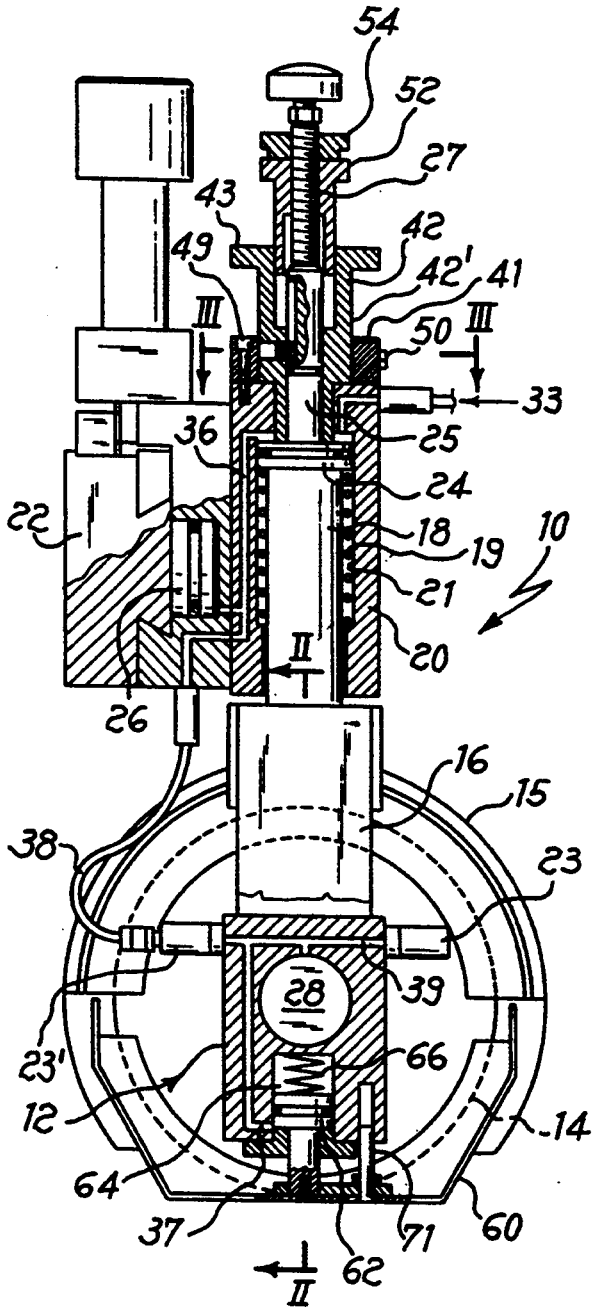
FIG. 1 shows a schematic view of an axial section of the improved cutting unit of the present invention.

With reference to the figures the improved cutting unit of the present invention indicated as a whole by reference number 10 comprises a hollow supporting body (20) and a blade holder head (12) equipped with a round blade (14) mounted in cantilever and partially protected by a case (15). Said blade holder head (12) is connected through an elastically deformable arm (16) to a shaft (18) fitted with a piston (24) and inserted in a sliding manner in the cavity (21) of the supporting body (20). A coil spring (19) arranged in the cavity (21) acts on the piston (24) holding the shaft (18) and the blade holder head (12) in raised position, i.e. with the blade (14) distant from the counterblade (34).

The supporting body (20) can translate along a beam or the like (22) and a piston (26) arranged laterally in said supporting body (20) positions and holds fixed the supporting body (20) on the beam (22).

From the piston (24) extends a stem (25) of substantially circular section which projects above from the supporting body (20) and is fitted at the free end with a threaded portion (27).

Figure 6:
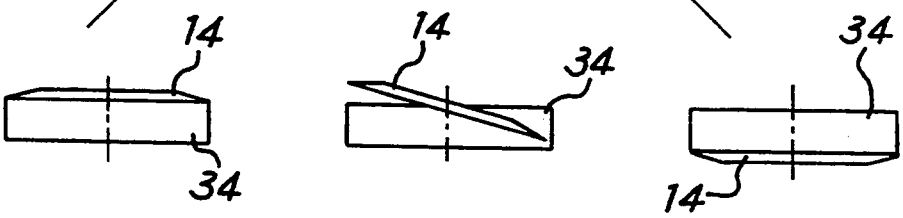
FIG. 6 shows schematically by way of example a sequence of plan views of some possible positions of the blade in relation to the counterblade.

Another piston (28) arranged in the blade holder head (12) and fitted with a shaft (30) supports through bearings (32) the round blade (14) and permits horizontal positioning of said round blade (14)in relation to a counterblade (34) illustrated schematically in FIG. 6.

Activation of the pistons (24,26,28) is determined by emission of a pressurised fluid, generally air, in the duct (33) of the supporting body (20). Through the passage (36) connected by a flexible tube (38) to other passages (39) present in the blade holder head (12) the pressurised fluid from the duct (33) reaches and moves the pistons (24,26,28) in accordance with well known techniques.

Figure 3:
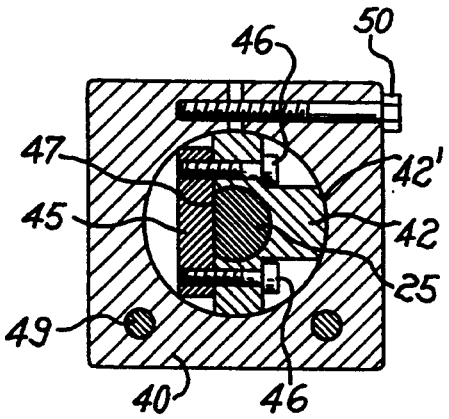
FIG. 3 shows a schematic view of a section through plane of cut III—III of FIG. 1.

A bushing (42) fitted with a flange (43) projects from the upper end of the supporting body (20). In the bushing (42) is torsionally constrained the stem (25) as illustrated in FIG. 3.

Said torsional constraint is provided by a key (45) made integral by screws (46) with the bushing (42) and by a planar face (47) present on the stem (25).

Said planar face (47), counteracting with the surface of the key (45) permits the blade holder head (12) and hence the corresponding round blade (14) to maintain in operation a perfectly axial position and thus avoid all rotation.

A substantially strip-from element (40) constrained to the supporting body (20) by screws (49) partially circumscribes (FIG. 3) the outer surface (42') of the bushing (42).

The substantially stripform element (40) can be made torsionally integral with the outer surface (42') of the bushing (42), drawing near its nonmating ends by screwing down of a bolt and screw (50) inserted in one end and screwed down in the other end.

When the screw (50) is loosened, the torsional constraint between the substantially stripform element (40) and the bushing (42) is freed and in this position the flange 43 can be rotated with resulting rotation of the bushing (42), stem (25) and blade holder head (12).

There is obtained in this manner regulation when required of the cutting angle of the round blade (14) which can be visually read from a graduated plate (41) present on the substantially stripform element (40). By tightening the screw (50) all rotation of the bushing (42) and hence of the stem (25) and blade holder head (12) is prevented.

Rotation of the blade holder head (12) can vary by any angle between 0° and 180° and in the latter position the round blade (14), being mounted cantilevered on the head (12) comes into contact with and uses the edge of the opposite side of the counterblade (34) as illustrated schematically in FIG. 6.

For this purpose the blade holder head (12) has two known mutually opposing quick couplings (23,23') to facilitate connection of the flexible tube (38) to the passage (39).

Figure 7:
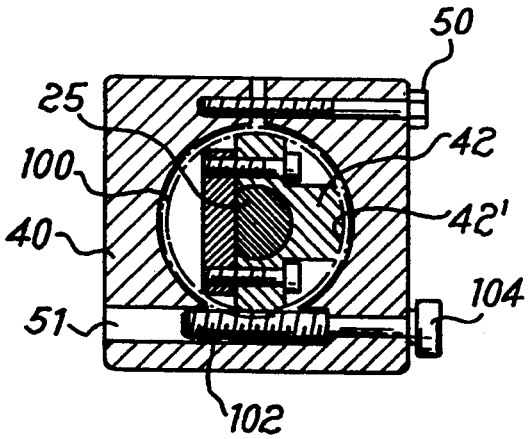
FIG. 7 shows a schematic partially sectioned plan view of a section of a device for micrometric rotation of the blade holder head and hence adjustment of the cut-off angle formed between the blade and the counterblade.

To allow regulated micrometric rotation of the stem (25) and hence the blade holder head (12) so that the blade (14) can be perfectly and accurately positioned in relation to the counterblade (34) by any minimum angle required for cutting off the material, the cutting unit (10) of the present invention can preferably comprise also a device for micrometric adjustment as illustrated in FIG. 7.

Said micrometric adjustment device for the cut-off angle formed between the round blade (14) and the counterblade (34) comprises a ring gear (100) cooperating with a worm (102) fitted with an operating knob (104).

The ring gear (100) is made directly on the outer surface (42') of the bushing (42) opposite the portion circumscribed by the stripform element (40).

The worm (102) is inserted in a cavity (51) made in the stripform element (40) in a position opposite the bolt (50).

Preferably the worm (102) presents a pitch such as to allow micrometric angular movements of the bushing (42) and hence of the round blade (14). This permits accurate and controlled positioning between said round blade (14) and the counterblade (34).

In addition, on the threaded portion (27) of the stem (25) are present ringnuts (52,54) designed for adjusting the axial movement of the blade holder head (12), i.e. the descending travel of the round blade (14) in its operation phase, i.e. approach to the counterblade (34).

In accordance with another characteristic of the improved cutting unit (10) of the present invention the blade holder head (12) includes opposite its lower end facing the counterblade (34) another protection case (60) for the round blade (14) whether the latter is operating or not. By means of said additional case (60) the blade (14) is always protected, preventing any accidental contact by the operator therewith. The case (60) is fixed to the stem of a piston (62) arranged in a chamber (64) made in the lower part of the blade holder head (12). A counteracting spring (66) protects the segment of the round blade (14) not protected by the other above mentioned case (15).

Figure 5:
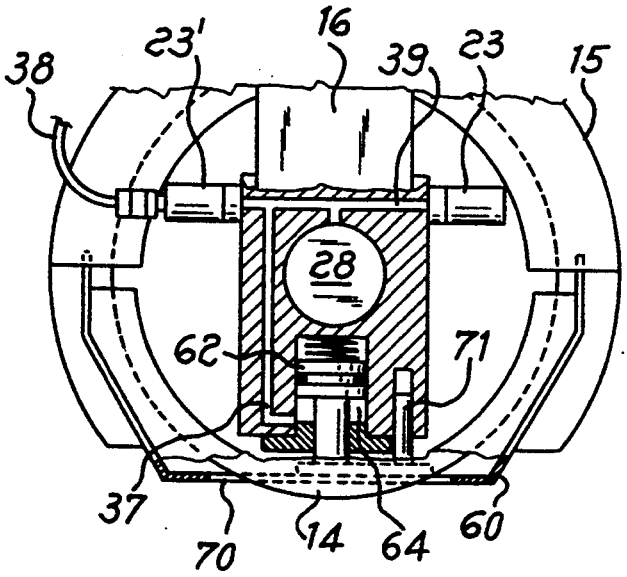
FIG. 5 is a schematic partial view of a section showing the positioning of the blade protection element during operation.

In the operating phase of the round blade (14) the case (60) is brought near the blade holder head (12) allowing a limited segment of the blade (14) to project through the opening (70) (FIG. 2) with which the case (60) is provided below. Said segment is sufficient to perform a material cut-off (see FIG. 5).

The approach guided axially by a pin (71) is obtained by axial movement of the piston (62) which, overcoming the counteraction of the spring (66), slightly lifts the case (60).

Said axial movement of the piston (62) is achieved by emission of pressurised fluid in the duct (33) which through the passages (36) of the supporting body (20) is introduced in the flexible tube (38) into the passages (39) of the blade holder head (12) and then into the passage (37) communicating with the chamber (64).

In other words the pressurised fluid causes simultaneously blocking of the cutting unit (10) on the beam (22) acting on the piston (26), lowering of the blade holder head (12) acting on the piston (24), axial movement of the blade (14) acting on the piston (28) and raising of the case (60) acting on the piston (62).

Figure 2:
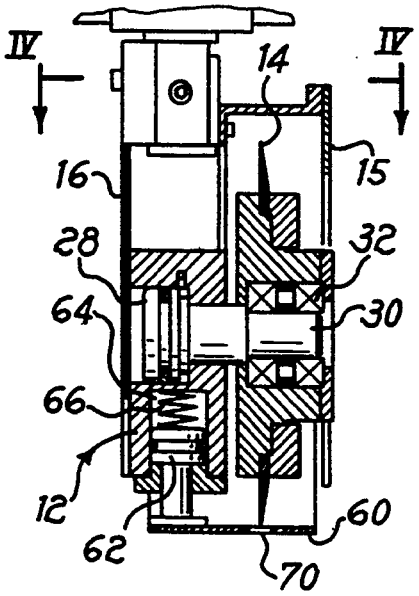
FIG. 2 shows a schematic view of a section through plane of cut II—II of FIG. 1.
Figure 4:
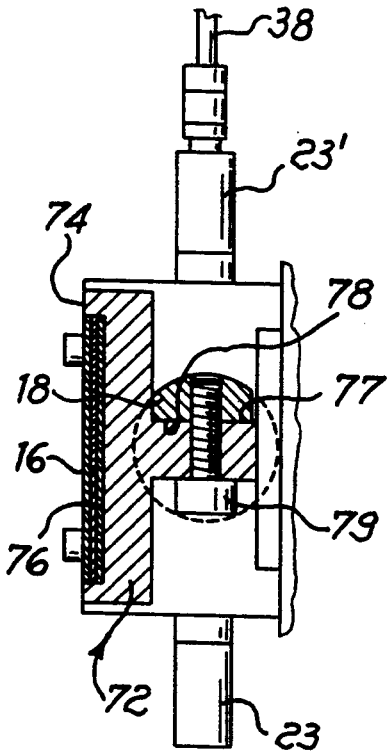
FIG. 4 shows a schematic view of a section through plane of cut IV—IV of FIG. 2.

With special reference to FIGS. 4 and 2 attention is drawn to the special and original coupling of the blade holder head (12) at the lower end of the shaft (18) projecting from the supporting body (20).

Said coupling includes an element (72) which in section assumes essentially the form of the letter T whose external major side (74) presents a lower portion (76) designed to received and to which is constrained the elastically deformable arm (16). The minor side (77) and in part the orthogonal side adjacent to said T element (72) counteract and are constrained by screws (79) with planar faces (78) provided at the lower end of the shaft (18), maintaining always perfectly and firmly positioned the blade holder head (12). Said blade holder head (12) can be quickly and easily replaced by unscrewing said screws (79).

From the foregoing there appear clear technological advantages and useful effects of the improved cutting unit of the present invention. By way of example, it is recalled that:

a. it allows changing of the cutting angle of the cutting blade adjusting the cut-off angle in order to obtain perfect scissors-type cut-off of any stripform material such as aluminium film, fibre glass, fibre glass strips, plastic films, paper sheets, etc.;
b. it allows 180° rotation of the blade holder head to allow use of both the cutting edges of a counterblade (34);
c. it allows quick and simple replacement of the blade holder head by merely unscrewing one screw; and
d. it allows complete and automatic protection of the cutting blade, in particular in the nonoperating position, preventing any undesired accidents.

Although the invention has been described in conjunction with specific embodiments it is evident that many alternatives and variations will be apparent to those skilled in the art in light of the foregoing description. Accordingly, the invention is intended to embrace all of the alternatives and variations that fall within the spirit and scope of the appended claims.

I claim:

1. A cutting unit for cut-off of stripform material, comprising:

a hollow supporting body (20) translatable and positionable along a beam (22), a blade holder head (12) provided with a circular blade (14), a case (15) partially protecting said blade (14), a shaft (18) having an axis and a piston (24) running in a cavity (21) of the supporting body (20), said shaft (18) being connected to the blade holder head (12) by an elastically deformable arm (16), a stem (25) extending from said piston (24) and projecting above the supporting body (20) and having its free end (27) threaded, adjustment ringnuts (52,54) arranged on the threaded free end (27) of the stem (25) so as to cooperated with the supporting body (20) to thereby adjust the axial lowering movement of the blade holder head (12), means (24,26,28) for fixing the supporting body (20) on the beam (22) upon lowering of the blade holder head (12) in relation to a counterblade (34) and horizontal positioning of the blade (14) in relation to the counterblade (34), said means being operated by a pressurized fluid, means for controlled rotation of the blade holder head (12) about the axis of the shaft (18), said means including a bushing (42) for said stem (25) having a flange (43), a key (45) integral with said bushing (42) by means of screws (46) which cooperates with an axially extending planar face (47) on the stem (25) such that the blade holder head (12) maintains perfect rotational position during operation, a stripform element (40) having free ends fixed to the supporting body (20) and circumscribing at least partially said bushing (42) and constraining said bushing (42) by means of a threaded bolt (50) inserted in the free ends of the stripform element (40), unscrewing said bolt (50) permits the rotation of bushing (42) and blade holder head (12), and a second case (60) provided with an opening (70) for a complete covering and protection of the blade (14) both in operational and rest phase.

2. The cutting unit in accordance with claim 1, wherein the rotation angle of the blade holder head (12) is between 0° and 180°.

3. The cutting unit in accordance with claim 1, wherein the controlled rotation means for the blade holder head (12) comprises a ring gear (100) arranged directly on an outer surface (42') of the bushing (42) opposite the circumscribed portion of the stripform element (40) and a worm (102) inserted in a cavity (51) of the stripform element (40) cooperating with said ring gear (100) and provided with an operating knob (104).

4. The cutting unit in accordance with claim 3, wherein the pitch of the worm (102) permits micrometric angular movement of the bushing (42).

5. The cutting unit in accordance with claim 1, wherein the mounting means for the blade holder head (12) comprises a T element (72) having a major outer side (74) and a minor side (77) wherein the major outer side (74) presents a lowered portion (76) which receives and constrains the elastically deformable arm (16) while the minor side (77) includes an adjacent orthogonal side thereof which mates with planar faces (78) provided at the lower end of the shaft (18) and is constrained thereto by means of a screw (79).

6. The cutting unit in accordance with claim 1, wherein the second case (60) is fixed to a piston (62) arranged in a chamber (64) in the blade holder head (12), said piston (62) being biased by a spring (66) so as to hold said second case (60) in a position to protect the segment of said blade (14) and in particular in the blade's nonoperational position not sufficiently protected by the other case (15), said second case (60) being guided by a pin (71) so as to axially approach the blade holder head (12) during operation of said blade (14) and during operation said blade (14) projects slightly from the case (60) through an opening (70) therein.

7. The cutting unit in accordance with claim 6, wherein the approach of the second case (60) to the blade holder head (12) is achieved by pressurized fluid pumped into a passage (36) of the supporting body (20) which communicates with a passage (39) in said blade holder head (12) via a flexible tube (38) and then passes through a passage (37) communicating with the chamber (64) thereby activating the piston (62) which overcomes the bias of the spring (66) and brings about said approach.

8. The cutting unit in accordance with claim 7, wherein the blade holder head (12) is provided with two mutually opposed quick couplings (23,23') for coupling to said flexible tube (38).

* * * * *